US009125471B2

(12) United States Patent
Ko

(10) Patent No.: US 9,125,471 B2
(45) Date of Patent: Sep. 8, 2015

(54) COSMETIC CONTAINER

(71) Applicant: TAIR JIUH ENTERPRISE CO., LTD., Tainan (TW)

(72) Inventor: Hou-Ju Ko, Taichung (TW)

(73) Assignee: TAIR JIUH ENTERPRISE CO., LTD., Tainan (TW)

( * ) Notice: Subject to any disclaimer, the term of this patent is extended or adjusted under 35 U.S.C. 154(b) by 333 days.

(21) Appl. No.: 13/835,712

(22) Filed: Mar. 15, 2013

(65) Prior Publication Data

US 2013/0330113 A1 Dec. 12, 2013

(30) Foreign Application Priority Data

Jun. 6, 2012 (TW) ..... 101210917 U

(51) Int. Cl.
*A45D 34/04* (2006.01)
*A45D 34/00* (2006.01)

(52) U.S. Cl.
CPC ..... *A45D 34/045* (2013.01); *A45D 34/00* (2013.01); *A45D 2034/002* (2013.01)

(58) Field of Classification Search
CPC ... A45D 29/22; A45D 34/042; A45D 34/045; A45D 2200/05; A45D 2200/20
USPC ..... 401/126, 129
See application file for complete search history.

(56) References Cited

U.S. PATENT DOCUMENTS

| | | | | |
|---|---|---|---|---|
| 8,397,931 | B2 * | 3/2013 | Palmer | 220/4.27 |
| 2003/0072602 | A1 * | 4/2003 | Gueret | 401/261 |
| 2004/0009309 | A1 * | 1/2004 | Raksha et al. | 427/598 |
| 2006/0088483 | A1 * | 4/2006 | Thevenet | 424/61 |
| 2006/0088484 | A1 * | 4/2006 | Thevenet | 424/61 |
| 2007/0125396 | A1 * | 6/2007 | Ramet | 132/73.5 |
| 2010/0156581 | A1 * | 6/2010 | Gueret | 335/219 |
| 2013/0160785 | A1 * | 6/2013 | Thevenet et al. | 132/200 |
| 2013/0213424 | A1 * | 8/2013 | Kim | 401/129 |

* cited by examiner

*Primary Examiner* — David Walczak
*Assistant Examiner* — Bradley Oliver
(74) *Attorney, Agent, or Firm* — Kirton McConkie; Evan R. Witt

(57) ABSTRACT

A cosmetic container includes a bottle, a cap unit and a magnetic member. The bottle is adapted for accommodating a magnetic nail polish having magnetic particles. The cap unit includes a cap body that removably covers the bottle, and a finger support that is mounted on the cap body. The magnetic member is mounted on the cap unit and includes a magnetic patterning portion. The magnetic member is disposed such that the fingernail of a finger that is supported on the finger support is proximate thereto, such that the magnetic patterning portion is able to attract the magnetic particles of the magnetic nail polish applied on the fingernail so as to forma corresponding pattern.

4 Claims, 9 Drawing Sheets

COSMETIC CONTAINER

CROSS-REFERENCE TO RELATED APPLICATION

This application claims priority of Taiwanese Patent Application No. 101210917, filed on Jun. 6, 2012.

BACKGROUND OF THE INVENTION

1. Field of the Invention

The invention relates to a cosmetic container, more particularly to a cosmetic container for storing magnetic nail polish.

2. Description of the Related Art

Nowadays, various nail polishing methods have been disclosed, including one that consists of the use of magnetic particles for pattern formation. Magnetic nail polish containing magnetic particles is stored like a regular nail polish in a conventional cosmetic container. To create a pattern, a magnet plate with a predetermined pattern is placed proximate to the polished nail surface so as to attract the magnetic particles in the magnetic nail polish to form a corresponding pattern. However, the magnet plate is an individual piece that does not come with the conventional cosmetic container, making it prone to getting lost and quite inconvenient for storing or carriage. Furthermore, it is necessary to maintain the stability of the magnet plate for a period of time when placed proximate to the nail surface since any slight displacement will affect the resulting pattern. Unfortunately, the conventional cosmetic container is not designed to support this aspect.

SUMMARY OF THE INVENTION

Therefore, the object of the present invention is to provide a cosmetic container that can eliminate the aforesaid drawbacks of the prior art.

According to the present invention, there is provided a cosmetic container that comprises a bottle, a cap unit and a magnetic member. The bottle is adapted for accommodating a magnetic nail polish that has magnetic particles (e.g. paramagnetic and/or ferromagnetic), and includes a mouth. The cap unit includes a cap body, a polish applicator and a finger support. The cap body removably covers the mouth of the bottle. The polish applicator extends downwardly from the cap body, is adapted to be received in the bottle when the cap body covers the mouth, and is adapted for applying the magnetic nail polish on a fingernail. The finger support is mounted on the cap body. The magnetic member is mounted on the cap unit and includes a magnetic patterning portion.

The magnetic member is disposed such that the fingernail of a finger that is supported on the finger support is proximate thereto, and such that the magnetic patterning portion is able to attract the magnetic particles of the magnetic nail polish applied on the fingernail so as to form a corresponding pattern.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
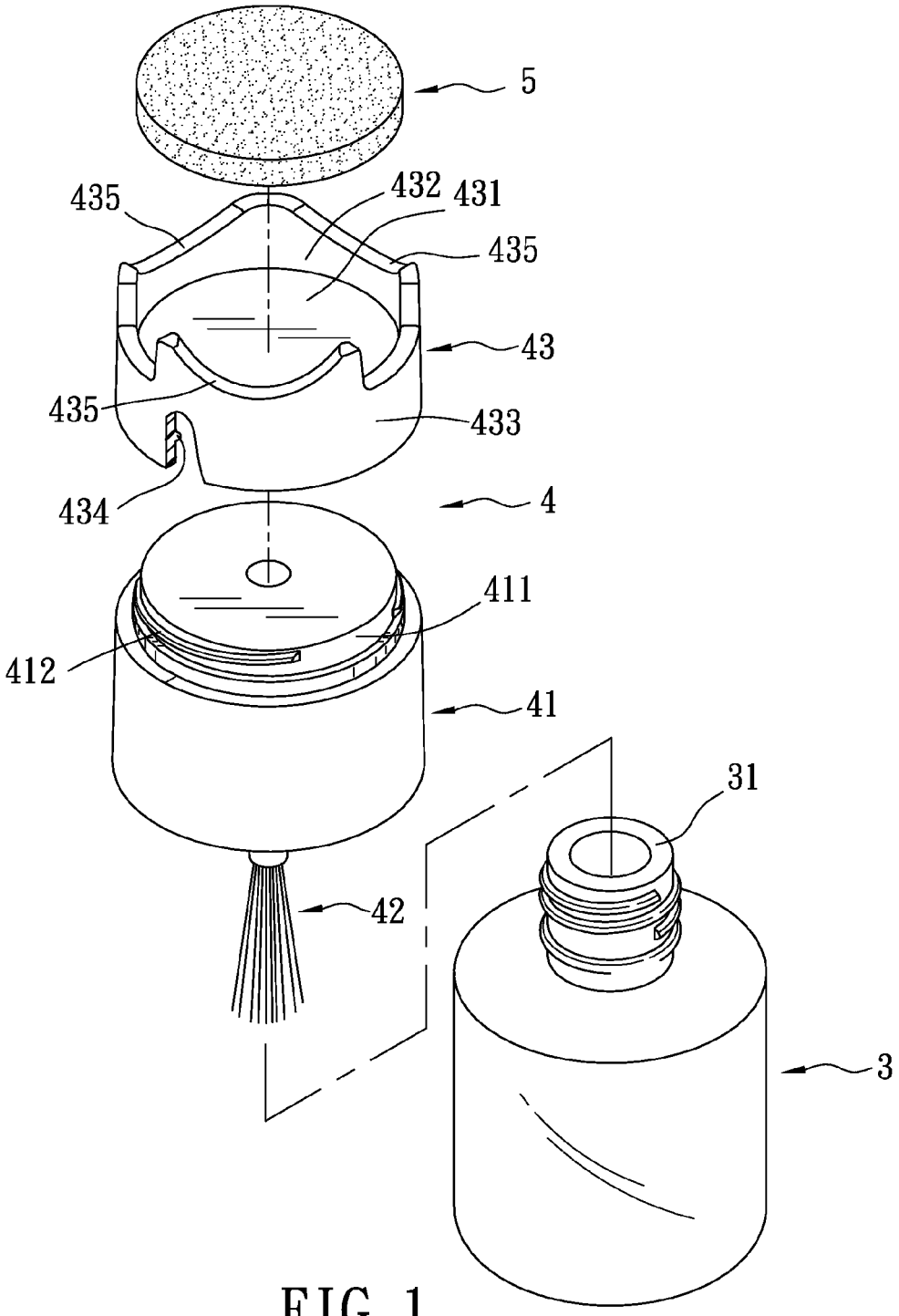
FIG. 1 is a partly exploded perspective view of the first preferred embodiment of a cosmetic container according to the present invention.

Before the present invention is described in greater detail, it should be noted that like elements are denoted by the same reference numerals throughout the disclosure.

Figure 2:
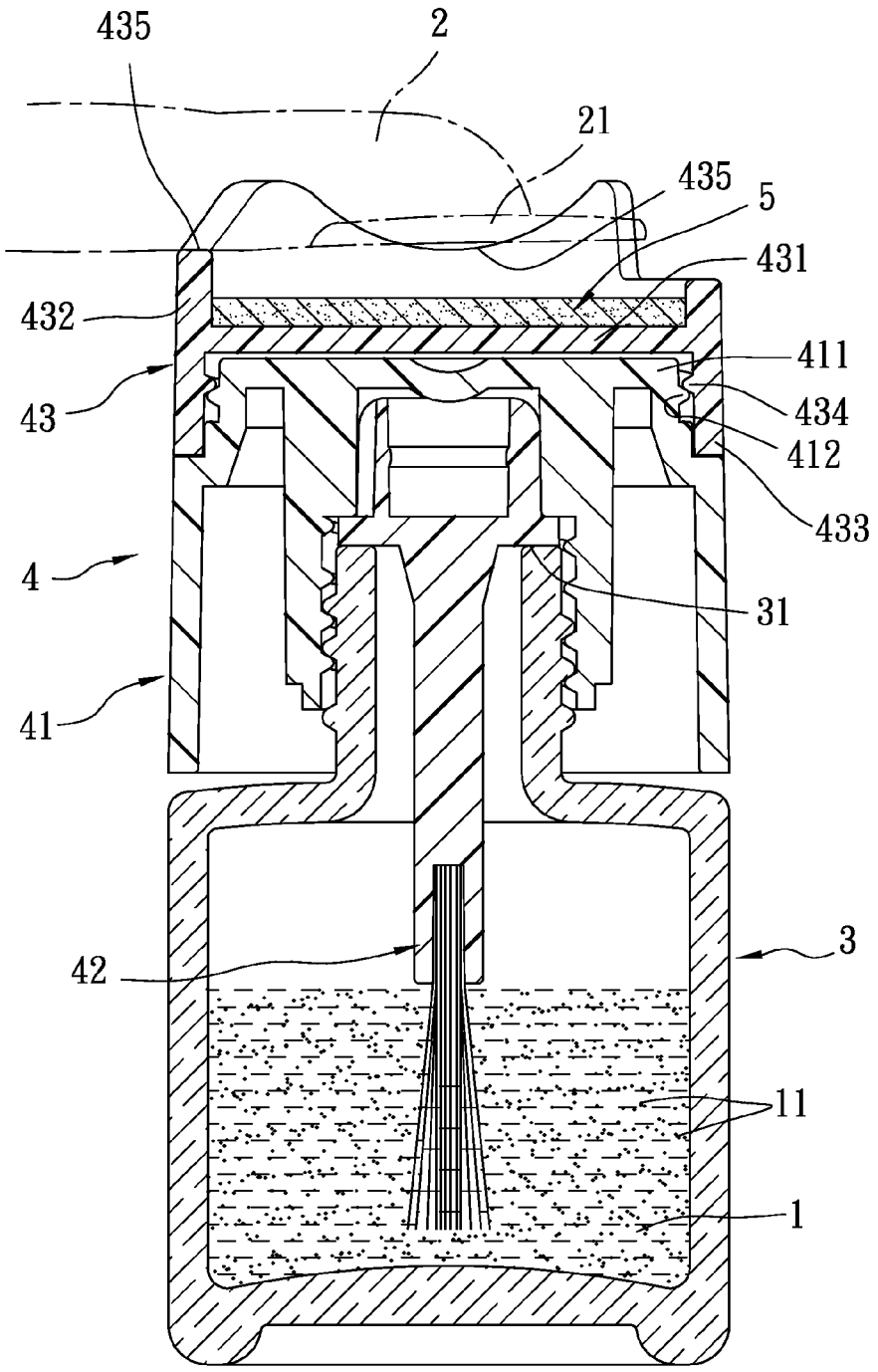
FIG. 2 is a side sectional view of the first preferred embodiment.
Figure 3:
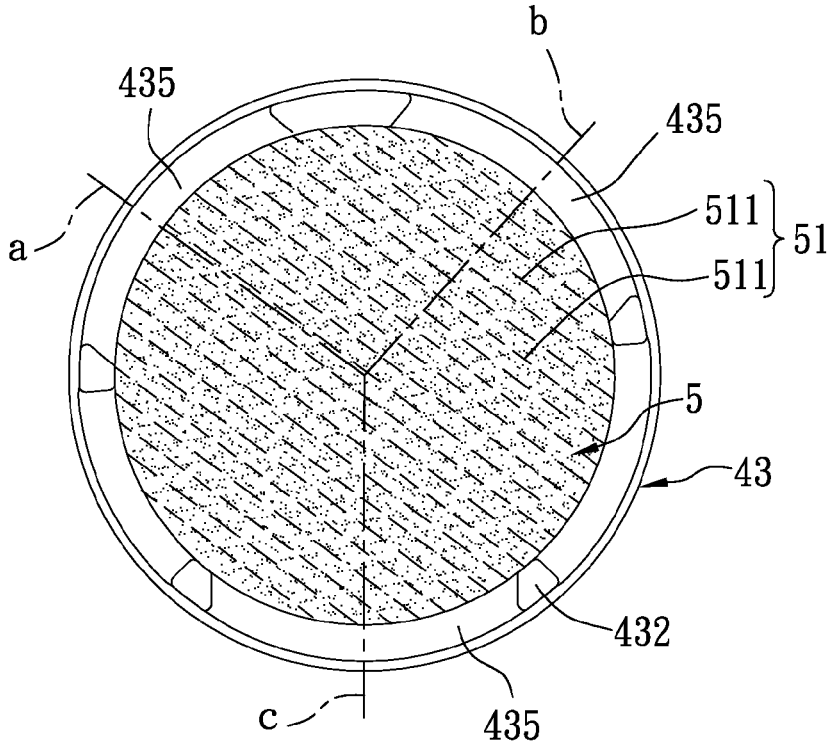
FIG. 3 is a top view of the first preferred embodiment.

Referring to FIGS. 1, 2 and 3, the first preferred embodiment of a cosmetic container according to the present invention is shown to be a nail polish container adapted for accommodating a magnetic nail polish 1 for painting a fingernail 21 of a finger 2. The cosmetic container includes a bottle 3, a cap unit 4, and a magnetic member 5.

The bottle 3 is transparent, is adapted for accommodating the magnetic nail polish 1 having magnetic particles 11, and includes a mouth 31 at a top thereof. Due to the bottle 3 having a well-known ordinary structure, further details will be omitted herein.

The cap unit 4 includes a cap body 41, a polish applicator 42, and a finger support 43.

The cap body 41 removably covers the mouth 31 of the bottle 3 and includes a constricted top portion 411. The polish applicator 42 extends downwardly from the cap body 41, is adapted to be received in the bottle 3 when the cap body 41 covers the mouth 31, and is adapted for applying the magnetic nail polish 1 on the fingernail 21. The finger support 43 is mounted on the cap body 41 and can be removed from the cap body 41 and placed on a flat surface for use.

It should be noted that the coupling between the cap body 41 and the bottle 3, and the coupling between the cap body 41 and the polish applicator 42 are not features of this invention, and hence details of the same are not further detailed hereinafter.

In this first embodiment, the finger support 43 of the cap unit 4 includes a mounting wall 431, an upper sidewall 432 and a lower sidewall 433. The mounting wall 431 is substantially planar in a horizontal direction. The upper sidewall 432 extends upwardly from the mounting wall 431 and extends beyond the cap body 41 when the finger support 43 is coupled to the cap body 41. The upper sidewall 432 has a top edge that is formed with at least one resting groove 435 that is adapted for the finger 2 to rest and position thereon. The lower sidewall 433 surrounds substantially and extends downwardly from the mounting wall 431 and the upper sidewall 432. The top portion 411 of the cap body 41 is provided with an outer thread 412, and the lower sidewall 433 of the finger support 43 is provided with an inner thread 434 capable of threaded engagement with the outer thread 412 so as to threadedly and removably couple the finger support 43 to the top portion 411 of said cap body 41.

The number of resting grooves 435 is three in this embodiment, but is not limited to what is disclosed herein. As shown in FIG. 3, the resting grooves 435 are angularly spaced apart, and centerlines (a, b, c) of the resting grooves 435 are not parallel among each other. An angle formed by the centerlines (a, b) is 90°, whereas an angle formed by centerlines (b, c) and an angle formed by centerlines (a, c) are both 135°. However, this should not be imposed as an implementation limitation of the present invention in practice.

The magnetic member 5 is disposed on the mounting wall 431 of the finger support 43, and includes a magnetic patterning portion 51. The magnetic member 5 is disposed in a way such that the fingernail 21 of the finger 2 that is supported on the resting groove 435 of the finger support 43 is proximate thereto, and such that the magnetic patterning portion 51 is able to attract the magnetic particles 11 of the magnetic nail polish 1 applied on the fingernail 21 so as to forma corresponding pattern. In this embodiment, the magnetic patterning portion 51 includes a plurality of magnetic force lines 511 that are arranged in stripes, enabling the magnetic particles 11 to be attracted thereby to form a striped pattern (not shown). In this embodiment, the magnetic force lines 511 are parallel to the centerline (a), perpendicular to the centerline (b), and inclined by a 135° angle to the centerline (c). In practice, the magnetic patterning portion 51 may take other patterns or text, such as concentric circles, cross-shaped, flower-shaped, English alphabets, etc.

When in use, the cap unit 4 is removed from the bottle 3 and the polish applicator 42 is then used to apply the magnetic nail polish 1 on the fingernail 21 of the finger 2. Before the applied magnetic nail polish 1 dries, the finger 2 is to be placed on one of the resting grooves 435 with the fingernail 21 facing down so as to be proximate to the magnetic member 5, such that the magnetic particles 11 in the applied magnetic nail polish 1 are attracted by the magnetic member 5 to form a pattern corresponding to the magnetic patterning portion 51. When the finger 2 is placed on different resting grooves 435, different patterns, or patterns with different orientations will appear on the fingernail 21. For example, in this embodiment, when the finger 2 is placed on the resting groove 435 with the centerline (a), a pattern of parallel vertical lines is to appear on the fingernail 21; when the fingernail 21 is placed on the resting groove 435 with the centerline (b), a pattern of parallel horizontal lines is to appear on the fingernail 21; and when the fingernail 21 is placed on the resting groove 435 with the centerline (c), a pattern of parallel slanted lines is to appear on the fingernail 21.

In addition, the cosmetic container of this invention can be individually packaged for sale, or can even be packaged with one or more additional finger supports 43 with magnetic members 5 having different patterning portions 51. This way, the user can freely change the finger support 43 in order to make different polishing patterns.

Figure 4:
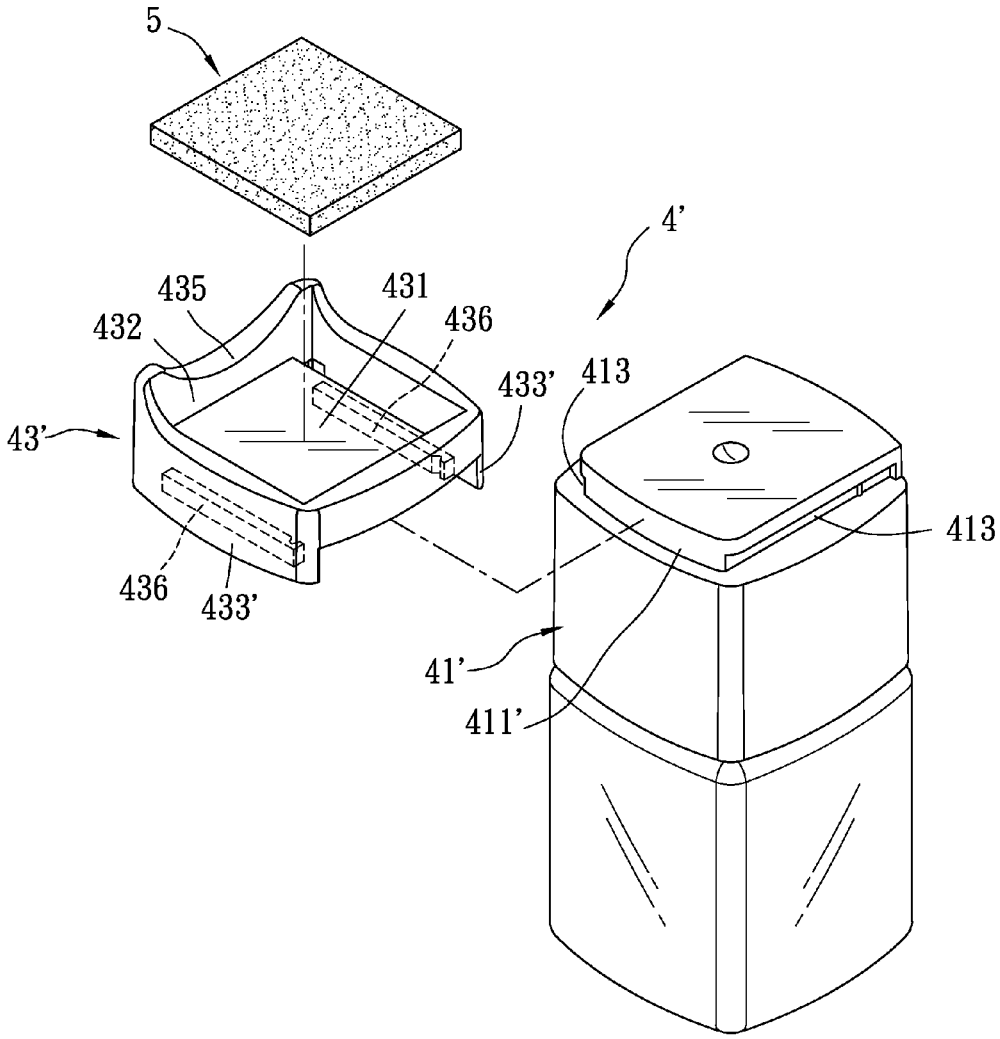
FIG. 4 is a partly exploded perspective view of the second preferred embodiment of a cosmetic container according to the present invention.
Figure 5:
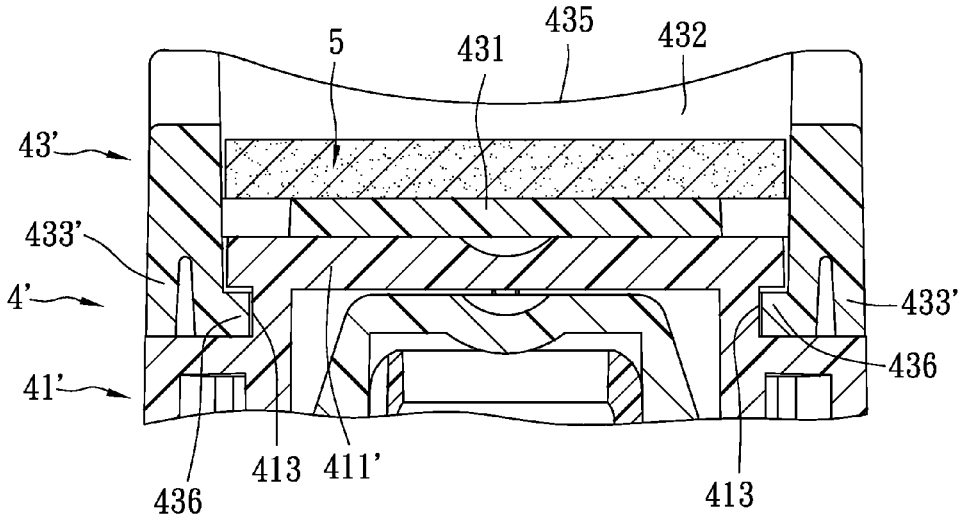
FIG. 5 is a fragmentary side sectional view of the second preferred embodiment.

Referring to FIGS. 4 and 5, the second preferred embodiment of a cosmetic container according to the present invention is shown to essentially differ from the first preferred embodiment in the structure of the cap unit 4'.

In this embodiment, the cap body 41' of the cap unit 4' includes a constricted top portion 411' having a square shaped cross section. The top portion 411' has two opposite lateral sides parallel to each other. The finger support 43' of the cap unit 4' includes amounting wall 431, an upper sidewall 432 and two lower sidewalls 433'. The mounting wall 431 has the magnetic member 5 mounted thereon. The upper sidewall 432 extends upwardly from the mounting wall 431 and extends beyond the cap body 41' when the finger support 43' is coupled to the cap body 41'. The lower sidewalls 433' are opposite and parallel to each other, and extend downwardly from the mounting wall 431 and the upper sidewall 432. Each of the lower sidewalls 433' of the finger support 43' is provided with a protruding rib 436, and each of the lateral sides of the top portion 411' is provided with a guiding groove 413. The guiding grooves 413 of the lateral sides of the top portion 411' are capable of slidable engagement with the protruding ribs 436 of lower sidewalls 433' of the finger support 43', respectively so as to slidably and removably couple the finger support 43' to the top portion 411' of the cap body 41'. It is noted herein that the places of formation of the protruding ribs 436 and the guiding grooves 413 can interchange in other embodiments of the present invention. The upper sidewall 432 has a top edge that is exemplified as being formed with only one resting groove 435. In practice, the second preferred embodiment also allows for removal and replacement of different finger supports 43' according to practical needs.

Figure 6:
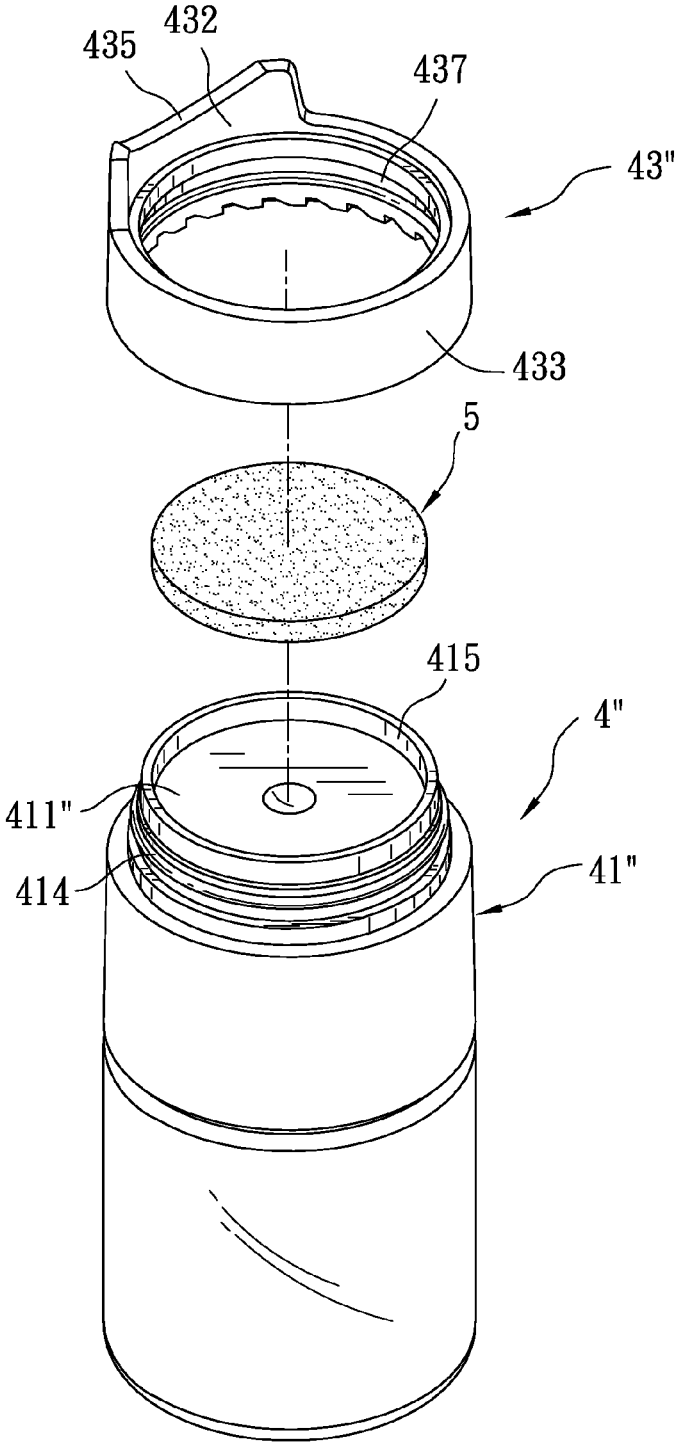
FIG. 6 is a partly exploded perspective view of the third preferred embodiment of a cosmetic container according to the present invention.
Figure 7:
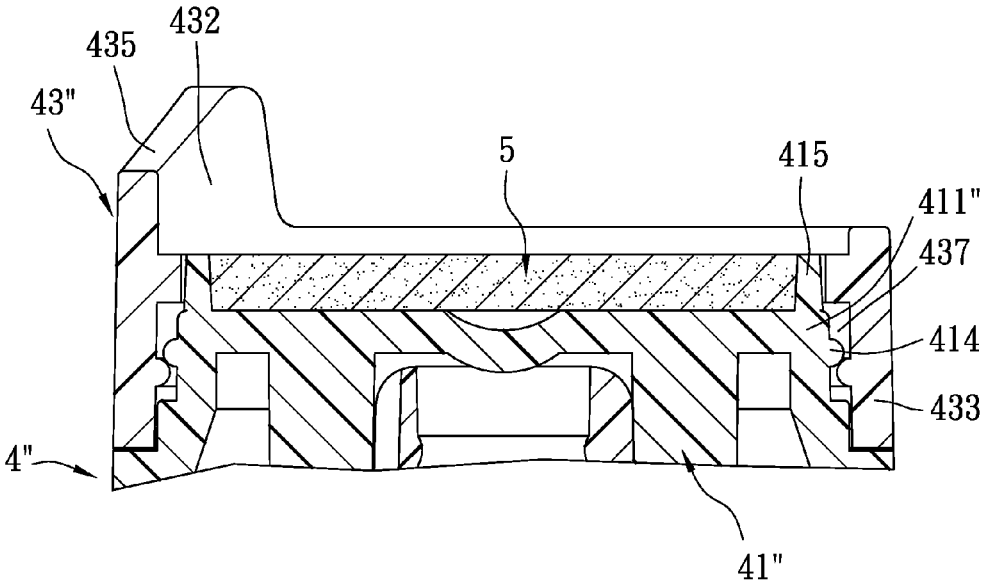
FIG. 7 is a fragmentary side section view of the third preferred embodiment.

Referring to FIGS. 6 and 7, the third preferred embodiment of a cosmetic container according to the present invention is shown to illustrate an alternative structure of the cap unit 4".

The cap body 41" of the cap unit 4" includes a constricted top portion 411" that has an outer surface, and an annular flange 415 that extends upwardly from a top surface of the top portion 411" and that defines a receiving space for the magnetic member 5 to be disposed therein. Contrary to the previous embodiments, the finger support 43" includes an upper sidewall 432 and a lower sidewall 433, but no mounting wall 431 (as shown in FIG. 2). The upper sidewall 432 extends upwardly beyond the cap body 41" when the finger support 43" is coupled to the cap body 41" and has a top edge that is formed with one resting groove 435. The lower sidewall 433 extends downwardly from the upper sidewall 432, surrounds the top portion 411" of the cap body 41", and has an inner surface. The outer surface of the top portion 411" of the cap body 41" is provided with a protruding ring 414, and the inner surface of the lower sidewall 433 of the finger support 43" is formed with an annular groove 437 that engages the protruding ring 414 so that the finger support 43" is rotatably mounted on the top portion 411" of the cap body 41". When in use, the finger support 43" can be rotated to adjust the position of the resting groove 435 in relation to the magnetic member 5, so when the finger 2 (shown in FIG. 2) is placed on the resting groove 435, a different pattern may be formed on the fingernail 21 due to the different adjusted positions. It should be noted herein that it may as well be that the outer surface of the top portion 411" of the cap body 41" is formed with the annular groove 437 and that the inner surface of the lower sidewall 433 of the finger support 43" is provided with the protruding ring 414 in other embodiments of the present invention.

Figure 8:
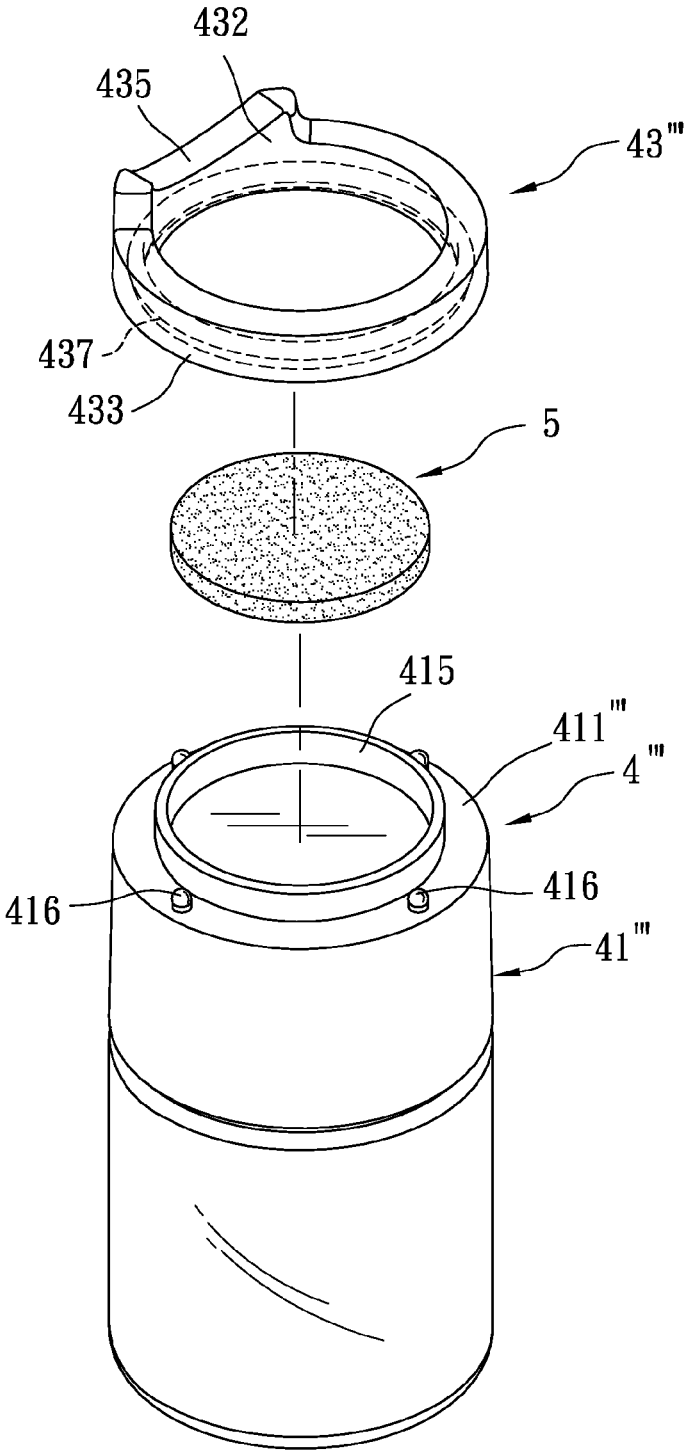
FIG. 8 is a partly exploded perspective view of the fourth preferred embodiment of a cosmetic container according to the present invention.
Figure 9:
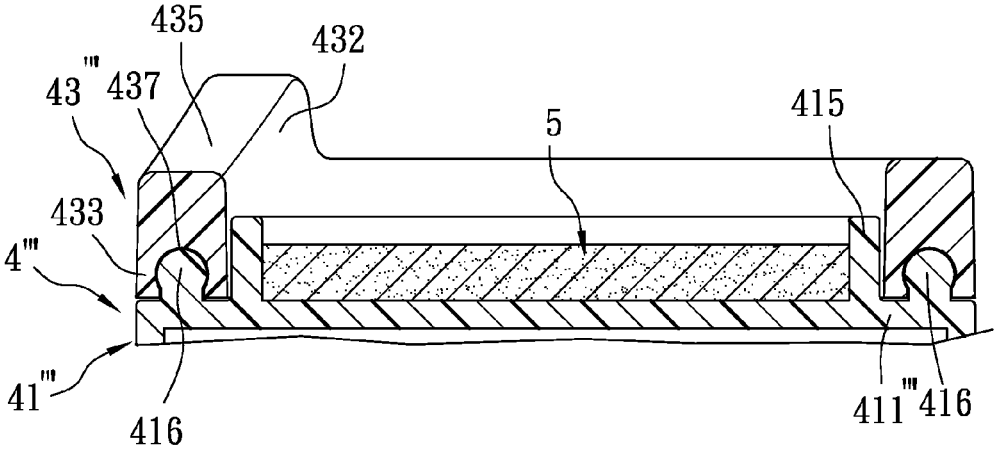
FIG. 9 is a fragmentary sectional view of the fourth preferred embodiment.

Referring to FIGS. 8 and 9, the fourth preferred embodiment of a cosmetic container according to the present invention demonstrates yet another alternative structure of the cap unit 4'''.

In this embodiment, the cap body 41''' has a top portion 411''' that has a top surface. The finger support 43''' includes an upper sidewall 432 and a lower sidewall 433. The upper sidewall 432 extends upwardly beyond the cap body 41''' when the finger support 43''' is coupled to the cap body 41''' and has a top edge that is formed with one resting groove 435. The lower sidewall 433 extends downwardly from the upper sidewall 432, surrounds the top portion 411''' of the cap body 41''', and has a bottom surface. The top surface of the top portion 411''' of the cap body 41''' is provided with a plurality of protruding studs 416, and the bottom surface of the lower sidewall 433 of the finger support 43''' is formed with an annular groove 437 that engages the protruding studs 416 so that the finger support 43''' is rotatably mounted on the top portion 411''' of the cap body 41'''. It is noted herein that in an alternative arrangement, the protruding studs 416 may be provided on the bottom surface of the lower sidewall 433 of the finger support 43''', while the annular groove 437 is formed in the top surface of the top portion 411''' of the cap body 41'''. The fourth preferred embodiment achieves the same effect as the third preferred embodiment.

In summary, the cosmetic container of this invention provides the magnetic member 5 directly on the cap unit 4 so that these two entities are carried and stored as a set, preventing the magnetic member 5 from getting lost and providing ready access to the magnetic member 5 for a user. Moreover, the provision of the finger support 43 on the top portion 411 of the cap body 41 of the cap unit 4 for the finger 2 to be placed and rested thereon prevents the finger 2 from undesired displacements, making this invention easy to use with improved cosmetic effect.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A cosmetic container comprising:

a bottle adapted for accommodating a magnetic nail polish that has magnetic particles, and including a mouth;

a cap unit including a cap body that removably covers said mouth of said bottle, a polish applicator that extends downwardly from said cap body, that is adapted to be received in said bottle when said cap body covers said mouth and that is adapted for applying the magnetic nail polish on a fingernail, and a finger support that is mounted on said cap body; and a magnetic member mounted on said cap unit and including a magnetic patterning portion, said magnetic member being disposed such that the fingernail of a finger that is supported on said finger support is proximate thereto, and such that said magnetic patterning portion is able to attract the magnetic particles of the magnetic nail polish applied on the fingernail so as to form a corresponding pattern;

wherein said finger support of said cap unit includes an upper sidewall extending upwardly beyond said cap body when said finger support is coupled to said cap body, and having a top edge that is formed with at least one resting groove, which is adapted for the finger to rest and position thereon, wherein said cap body of said cap unit further has a top portion that has a top surface, said finger support further including a lower sidewall that extends downwardly from said upper sidewall, that surrounds said top portion of said cap body, and that has a bottom surface; and wherein one of said top surface of said top portion of said cap body and said bottom surface of said lower sidewall of said finger support is provided with a plurality of protruding studs, and the other of said top surface of said top portion of said cap body and said bottom surface of said lower sidewall of said finger support is formed with an annular groove that engages said protruding studs so that said finger support is rotatably mounted on said top portion of said cap body.

2. The cosmetic container as claimed in claim 1, wherein said top edge of said upper sidewall is formed with a plurality of said resting grooves that are angularly spaced apart.

3. A cosmetic container comprising:

a bottle adapted for accommodating a magnetic nail polish that has magnetic particles, and including a mouth;

a cap unit including a cap body that removably covers said mouth of said bottle, a polish applicator that extends downwardly from said cap body, that is adapted to be received in said bottle when said cap body covers said mouth and that is adapted for applying the magnetic nail polish on a fingernail, and a finger support that is mounted on said cap body; and a magnetic member mounted on said cap unit and including a magnetic patterning portion, said magnetic member being disposed such that the fingernail of a finger that is supported on said finger support is proximate thereto, and such that said magnetic patterning portion is able to attract the magnetic particles of the magnetic nail polish applied on the fingernail so as to form a corresponding pattern;

wherein said finger support of said cap unit includes an upper sidewall extending upwardly beyond said cap body when said finger support is coupled to said cap body, and having a top edge that is formed with at least one resting groove, which is adapted for the finger to rest and position thereon;

wherein said cap body of said cap unit has a top portion that has an outer surface, said finger support further including a lower sidewall that extends downwardly from said upper sidewall, that surrounds said top portion of said cap body, and that has an inner surface; and wherein one of said outer surface of said top portion of said cap body and said inner surface of said lower sidewall of said finger support is provided with a protruding ring, and the other of said outer surface of said top portion of said cap body and said inner surface of said lower sidewall of said finger support is formed with an annular groove that engages said protruding ring so that said finger support is rotatably mounted on said top portion of said cap body;

wherein said cap body further includes an annular flange extending upwardly from a top surface of said top portion, surrounded by said lower sidewall of said finger support, and defining a receiving space, said magnetic member being disposed in said receiving space.

4. The cosmetic container as claimed in claim 3, wherein said top edge of said upper sidewall is formed with a plurality of said resting grooves that are angularly spaced apart.

* * * * *